US007905679B2

(12) United States Patent
Vrondran et al.

(10) Patent No.: US 7,905,679 B2
(45) Date of Patent: Mar. 15, 2011

(54) DUAL LIFTING MANHOLE COVER

(75) Inventors: Kevin S. Vrondran, East Jordan, MI (US); Jeremy I. Johnson, East Jordan, MI (US); Andrew J. Malpass, East Jordan, MI (US)

(73) Assignee: East Jordan Iron Works, Inc., East Jordan, MI (US)

( * ) Notice: Subject to any disclaimer, the term of this patent is extended or adjusted under 35 U.S.C. 154(b) by 635 days.

(21) Appl. No.: 11/938,444

(22) Filed: Nov. 12, 2007

(65) Prior Publication Data

US 2009/0123227 A1 May 14, 2009

(51) Int. Cl.
*E02D 29/14* (2006.01)

(52) U.S. Cl. ..... 404/25; 454/48; 137/371; 52/19

(58) Field of Classification Search ..... 404/25, 404/26; 454/48; 137/371; 52/19
See application file for complete search history.

(56) References Cited

U.S. PATENT DOCUMENTS

| | | | | | |
|---|---|---|---|---|---|
| 2,323,886 | A * | 7/1943 | Wirz, Jr. | 292/304 |
| 2,655,399 | A * | 10/1953 | McMillan | 294/17 |
| 3,209,663 | A * | 10/1965 | Baier | 49/395 |
| 4,101,236 | A * | 7/1978 | Meyer | 404/25 |
| 4,123,184 | A * | 10/1978 | Whitlock | 404/25 |
| 4,482,182 | A * | 11/1984 | Mortensen | 294/15 |
| 4,523,407 | A * | 6/1985 | Miller | 49/465 |
| D306,482 | S * | 3/1990 | Milo | D25/36 |
| 5,462,385 | A * | 10/1995 | Mohlengraft | 404/25 |
| 5,865,425 | A * | 2/1999 | Meadows | 254/131 |
| 6,109,822 | A * | 8/2000 | Campbell et al. | 404/25 |
| 6,202,986 | B1 * | 3/2001 | Goldman | 254/131 |
| 6,595,566 | B1 * | 7/2003 | Donnan | 294/16 |
| 2008/0159810 | A1 * | 7/2008 | Myers | 404/83 |

* cited by examiner

*Primary Examiner* — Robert E Pezzuto
*Assistant Examiner* — Matthew D Troutman
(74) *Attorney, Agent, or Firm* — Warner Norcross & Judd LLP

(57) ABSTRACT

A one-piece, unitary manhole cover has dual lifting ports that drain through the outer circumferential edge of the cover. A lifting channel runs from the interior of the upper face out to the outer circumferential edge. A lifting bar spans the lifting channel and defines an ergo lifting port and a pry bar lifting port. Both the ergo lifting port and the pry bar lifting port drain through the outer circumference of the manhole cover.

12 Claims, 4 Drawing Sheets

DUAL LIFTING MANHOLE COVER

BACKGROUND OF THE INVENTION

The present application relates to manhole cover assemblies, and, more particularly, to a manhole cover with dual lifting ports.

Manholes are well-known and widely utilized. Generally, a manhole provides access for maintenance of infrastructure, for instance, underground pipelines or cabling. Traditional manhole covers rest on a frame that is attached to the substructure above infrastructure to be maintained. Examples of such substructure include the base for a road or sidewalk. The cover rests on this frame and must be lifted away to gain access to the infrastructure beneath the manhole. Because manhole covers are predominantly made of iron and can weigh in excess of 100 pounds, the effort required to lift a manhole cover can be difficult and even injurious to the operator.

Many attempts have been made to ease the effort required to lift a manhole cover from its frame. For example, some manhole covers include a hole extending through the cover. To lift the cover, an operator inserts a pointed tool through the hole to either pry up or lift the cover. This method provides some additional lifting leverage, but the hole in the cover provides direct access for external contaminants to drain below to the infrastructure.

Other manhole covers include a lifting insert within the upper face of the cover. These lifting inserts are typically cast inserts that are placed in a recess in the face of the cover. The inserts define a cutout in the face of the cover, and they include a bar that extends over the cutout such that a pointed tool could be wedged underneath or against the bar to provide lifting leverage. The cutout is typically symmetrical in shape, and it typically does not extend completely through the insert to prevent external contaminants from draining through the cover. To open such a cover, an operator wedges a tool into the cutout and underneath or against the bar, and applies a force on the bar, lifting the cover away from the frame. This type of cover prevents outside contaminants from draining directly into the infrastructure, but new problems arise due to runoff and other debris that tend to collect in the cutout. Thus, an operator may be required to clear out the cutout prior to opening the cover. In addition, installing an insert in this way may generate increased manufacturing costs because of the additional steps necessary to fabricate such a cover.

SUMMARY OF THE INVENTION

The aforementioned problems are overcome by the present invention wherein a one-piece, unitary manhole cover is provided with a channel that defines a cutout in the upper face of the cover and that extends through the outer edge of the cover. A lifting bar bridges the channel and forms two separate openings in the upper face of the cover. The channel and the lifting bar are configured to form dual lifting ports, one on each side of the lifting bar, that enable easy removal of the cover by prying or lifting.

In one embodiment, a first end of the lifting channel and a first sidewall of the lifting bar cooperate to define an ergo lifting port that receives a lifting tool. The second end of the channel and a second sidewall of the lifting bar cooperate to define a pry bar lifting port. The pry bar lifting port may be located at the outer end of the channel, and may extend through the outer circumferential edge of the cover. In one embodiment, the ergo lifting port includes an arc-shaped portion of the lifting channel floor, and a lobe extending downwardly from the lower surface of the lifting bar. The portion of the floor and the lobe cooperate to receive and provide leverage for a lifting tool. In one embodiment, the pry bar lifting port includes a generally planar portion of the lifting channel floor and a generally planar portion of the lower surface of the lifting bar. The generally planar surfaces cooperate to receive and provide leverage for a pry tool.

The present invention provides a one-piece manhole cover that facilitates removal of the cover using either a specially designed lifting tool or a conventional, widely accessible pry bar lifting tool, allowing the operator to easily and efficiently open the cover. The floor of the channel prevents contaminants such as dirt and garbage from draining into the infrastructure below the manhole. Further, by extending through the outer circumferential edge of the cover, the channel allows contaminants to drain out of the channel through the outer edge of the cover.

These and other objects, advantages, and features of the invention will be readily understood and appreciated by reference to the detailed description of the current embodiment and the drawings.

DESCRIPTION OF THE CURRENT EMBODIMENT

Figure 1:
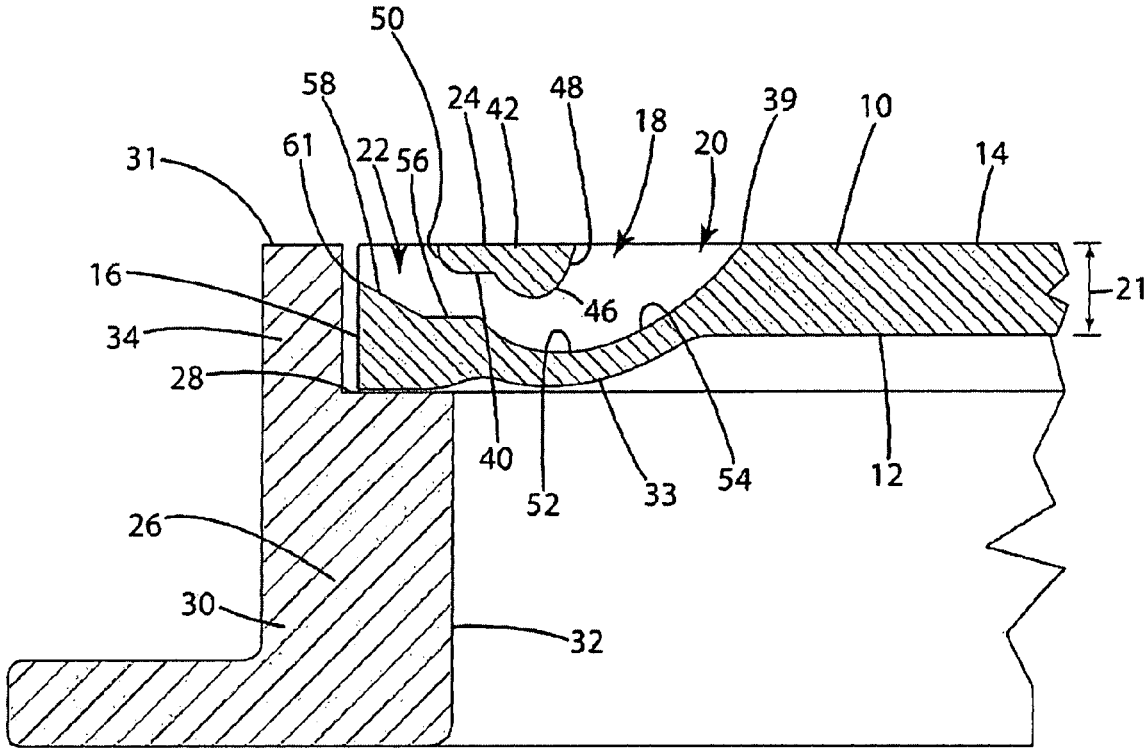
FIG. 1 is a partial side cross sectional view of the cover as received into a frame according to one embodiment of the present invention.
Figure 2:
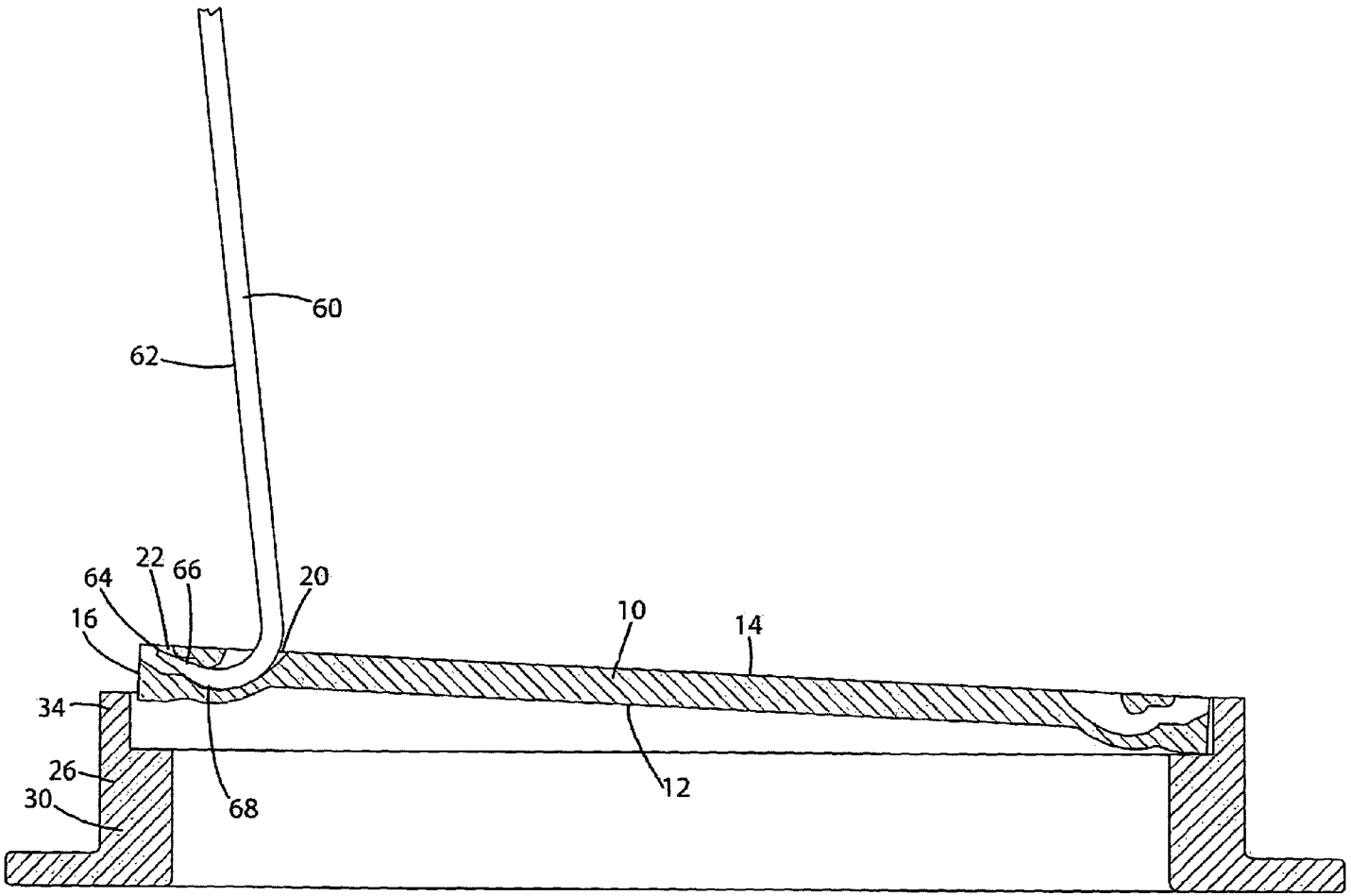
FIG. 2 is a side cross sectional view of cover lifted from the frame using the ergo lifting port.
Figure 3:
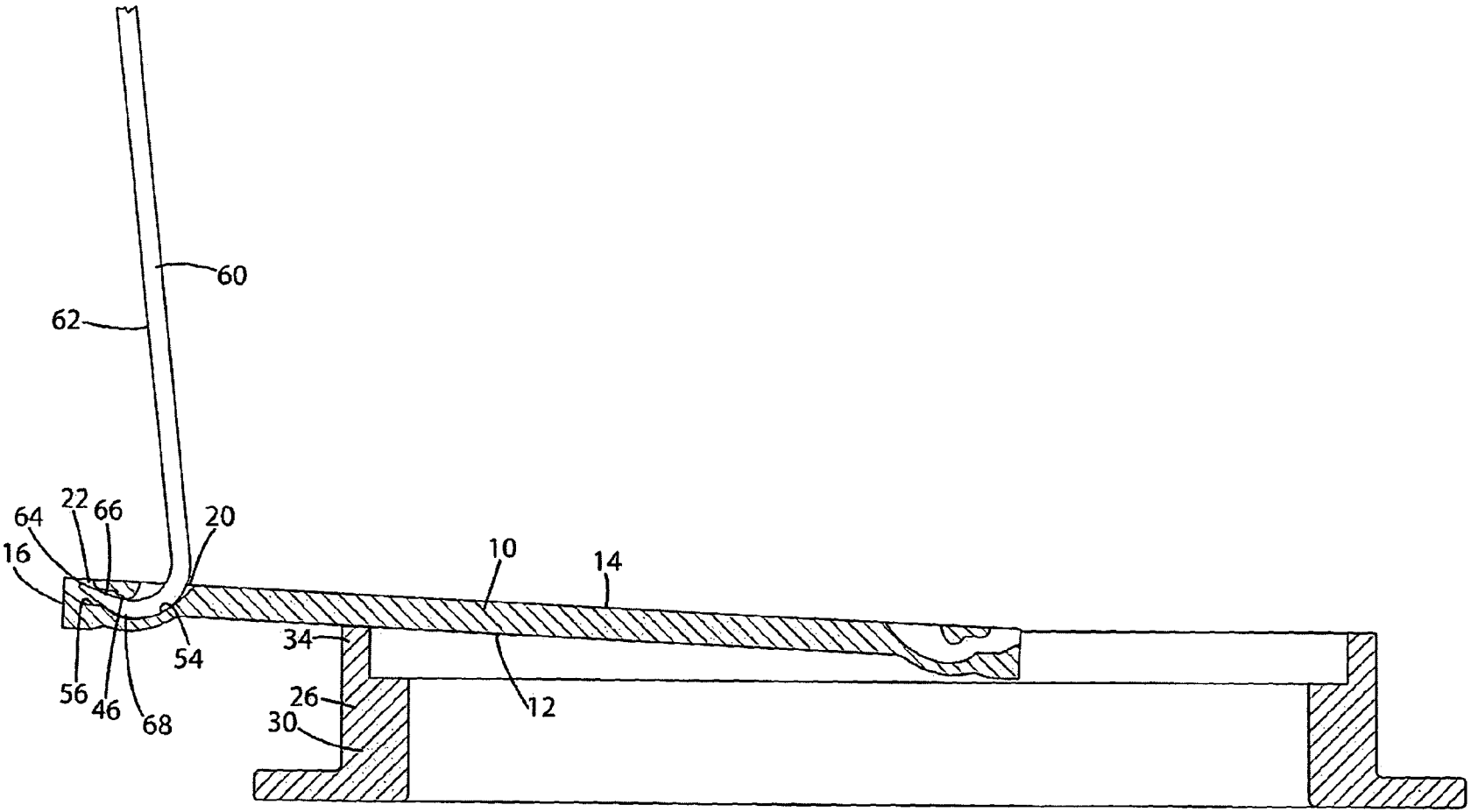
FIG. 3 is a side cross sectional view of the cover partially removed from the frame using the ergo lifting port.
Figure 4:
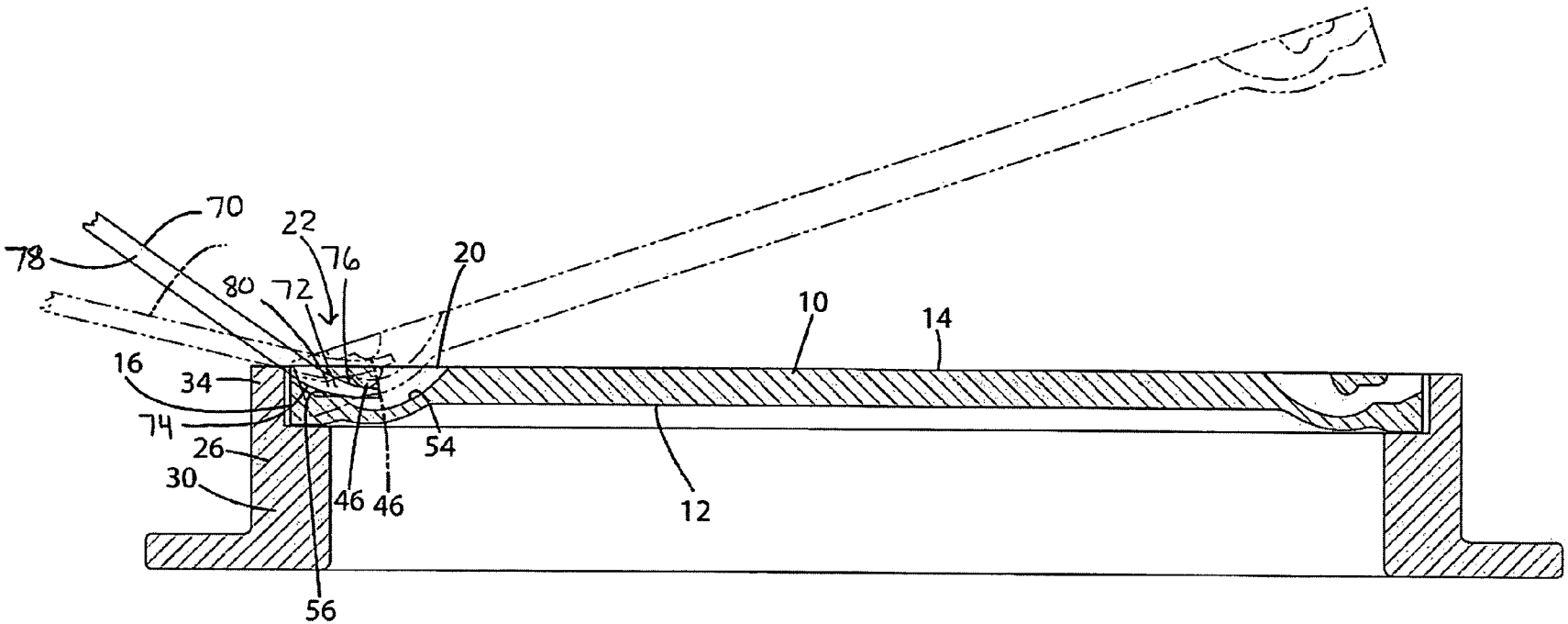
FIG. 4 is a side cross sectional view of the cover with a pry toll inserted in the pry bar lifting port, and showing the cover lifted from the frame using the pry bar lifting port in broken lines.

A manhole cover in accordance with one embodiment of the present invention is illustrated in the drawings and designated 10. In illustrated embodiment, the cover 10 has a lower face 12, an upper face 14, an outer circumferential edge 16 and at least one channel 18 defined in the upper face and extending to the outer circumferential edge 16. In one embodiment, the channel 18 is divided by a lifting bar 24 to define an ergo lifting port 20 and a pry bar lifting port 22. In operation, as illustrated in FIGS. 2-4, the cover 10 can be removed from the frame 26 in multiple ways, for instance, by inserting an ergo lifting tool 60 into the ergo lifting port 20 or a pry bar 70 into the pry bar lifting port 22. The channel 18 extends through the outer circumferential edge and provides means for fluid and debris to drain from the lifting channel 18.

In the illustrated embodiment, the cover 10 is a cast iron cover of an overall disc-shaped geometry. In other embodiments, the cover 10 could be of another geometry, and another material. In one embodiment, the entire cover 10 is formed from the same material, such that the material forming the channel 18 and lifting ports 20 and 22 is unitary with the material of the surrounding areas of the cover 10. In one embodiment, the channel 18, lifting bar 24 and lifting ports 20, 22 may be fabricated using a core within the overall cover mold. Suitable alternative materials and fabrication methods may also be utilized.

As noted above, the cover 10 has a lower face 12 and an upper face 14, and an outer circumferential edge 16. The cover defines a thickness 21 between the upper face 14 and lower face 12. In one embodiment, the upper face 14 may include projections and designs that indicate the owner of the cover 10, the manufacturer, the type of infrastructure beneath the manhole or any other pattern. The lower face 12 may include a downwardly extending projection 33 extending around the cover 10 proximate the outer circumferential edge 16, such that the thickness 21 of the cover increases proximate the outer circumferential edge 16.

The cover 10 is adaptable to be received by many different frame configurations. In the embodiment illustrated in the figures, the lower face 12 of the cover 10 rests on a cover support rim 28 of a frame 26. The frame 26 may include a frame wall 30 rising away from the substructure the frame 26 is mounted on. The frame wall 30 is an annular ring defining an inner surface 32. The cover support rim 28 projects from the inner surface 32 of the frame wall 30. An upper segment 34 of the frame wall 30 may extend beyond the cover support rim 28. The upper edge 31 of the upper segment 34 may be flush with the upper surface 14 of the cover when the cover 10 is in place on the cover support rim 28. The inside diameter of the frame wall 30 is slightly greater than the diameter of the cover 10 to provide clearance between the upper segment 34 of the frame wall 30 and the outer circumferential edge 16 of the cover 10 when the cover is installed on the frame 26. In another embodiment, the lower face of the cover could rest directly on the annular top of the frame wall.

In the illustrated embodiment, the cover 10 includes at least one channel 18 that defines openings in the upper face 14 for the ergo lifting port 20 and the pry bar port 22. The channel extends through the outer circumferential edge 16 toward the center of the cover 10. In one embodiment, two channels 18 are disposed on opposite sides of the cover 10. In other embodiments, one or more channels could be arranged in any configuration around the edge. The illustrated channel 18 includes a lifting bar 24 that extends across the width of the channel 18 and divides the channel 18 into the ergo lifting port 20 and the pry bar port 22. The illustrated channel 18 extends from the outer circumferential edge to an interior end 39 in the interior of the cover 10.

The channel includes a floor 52 that may be configured to receive an ergo lifting tool 60 through the ergo lifting port 20 and a pry tool 70 through the pry bar lifting port 22. In one embodiment, the floor 52 includes an ergo lifting arc 54, a pick leverage face 56 and a pry bar port lead in surface 58. In the embodiment illustrated in the figures, the ergo lifting arc 54 is a smooth, arcing surface extending from the upper face 14 of the cover 10 to the pick leverage face 56. A portion of the ergo lifting arc 54 extends below the pick leverage face 56. The pick leverage face 56 is a generally flat surface that connects the ergo lifting arc 54 to the pry bar port lead in surface 58. The plane of the illustrated pick leverage face 56 is parallel to the overall plane of the cover 10. The pry bar port lead in surface 58 extends from the pick leverage face 56 to the outer circumferential edge 16 of the cover 10. In the embodiment illustrated in the figures, the pry bar port lead in surface 58 is a ramped surface that slopes toward the upper face 14 of the cover 10 as the lead in surface 58 moves toward the outer circumferential edge 16 of the cover 10. The outer edge 61 of the pry bar port lead in surface is below the upper face 14 of the cover to define an opening in the outer circumferential edge 16 that allows the contents of the channel 18 drain over the pry bar port lead in surface 58 and through the outer circumferential edge 16.

As illustrated, the lifting bar 24 bridges the channel 18 and is spaced from the channel floor 52 to form the ceiling of the channel 18. The upper surface 42 of the lifting bar 24 may be flush with the upper face 14 of the cover 10. In one embodiment, an ergo lifting lobe 46 projects into the channel 18 from the lower surface 40 of the lifting bar 24. A first sidewall 48 of the lifting bar 24 may form a portion of the lifting lobe 46 and may transition in a rounded curve to the lower surface 40 of the lifting bar 24. A second sidewall 50 may also transition via a slightly rounded curve into the generally flat portion of the lower surface 40.

The interior end 39 of the channel 18 and the lifting bar 24 cooperate to define the ergo lifting port 20. In the illustrated embodiment, the ergo lifting port 20 is of an overall rectangular shape but the ergo lifting port 20 could be of alternate geometries to receive lifting tools 60 of various configurations. The ergo lifting port 20 is configured to receive a hook-shaped a lifting tool 60. As shown in FIGS. 2 and 3, one such tool includes a handle 62, a point 64, an upper face 66 and a lower face 68. In this embodiment of the tool 60, the handle 62 makes an angle of approximately 60° with the upper face 66 and lower face 68 of the tool 60. Various other lifting tools 60 are suitable for use with the cover 10, and the specific configuration of the lifting sector 18 can be adapted for the geometry of various lifting tool designs. In alternative embodiments, the angle may be adjusted to accommodate alternative lifting sector configurations, frames, operator heights, etc.

In operation, the point 64 of the tool 60 is inserted through the ergo lifting port 20, into the channel 18 and under the lifting bar 24. The arc shaped portion 54 of the channel 18 allows the tool 60 to enter the channel 18 with the lower face 68 of the tool 60 pressed against the pick leverage face 56, and the upper face 66 of the tool 60 pressed against the ergo lifting lobe 46. The operator applies a lifting force to the handle 62 of the tool 60, and leveraging forces are applied to the pick leverage face 56 and the ergo lifting lobe 46 allowing the operator to lift the cover 10 up and away from the frame 26, as can be seen in FIGS. 2 and 3.

In one embodiment, the pry bar lifting port 22 is a bi-planar aperture formed at the outer end 61 of the channel 18 where the outer circumferential edge 16 and upper face 14 of the cover 10 meet. Although the hook-shaped lifting tool 60 could be used in the pry bar lifting port to pry open the cover 10, various prying tools 70 are well-known in the art and more suitable for use with the pry bar port 22 of cover 10. One such prying tool is illustrated in FIG. 4. In this embodiment, the prying tool 70 includes a lifting arm 72 that has a lower face 74 and an upper face 76. An elbow 80 separates the lifting arm 72 from the handle 78 of the prying tool 70. To utilize the pry bar lifting port 22, the lifting arm 72 of the prying tool 70 is inserted through the pry bar lifting port 22, into the channel 18 and under the lifting bar 24. The lower face 74 presses against the pick leverage face 56 and the lead in surface 58, and the upper face 76 presses against the second sidewall 50 of the lifting bar 24. The operator applies a downward force to the handle 78 of the prying tool 70 causing the prying tool 70 to pivot about the elbow 80 which serves as a fulcrum. Lifting forces are then applied to the pick leverage face 56, the second sidewall 50 and lower surface of the lifting bar 40 allowing the operator to elevate the cover 10 for removal from the frame 26 (as shown in broken lines in FIG. 4). The operator may then rotate the cover away from the frame 26 to provide access to the infrastructure. The pry bar lifting port 22 is adapted to receive a range of prying tools 70 allowing operators to remove the cover 10 even if they do not have access to a tool designed specifically for removal of the particular cover 10.

In alternative embodiments, the ergo lifting port and pry bar lifting port may be alternatively sized or shaped to accept different styles of tools. In other embodiments, the lifting channel could be alternatively configured as well, based on the tool to be used. One or more of the ergo lifting arc, pick leverage face, pry bar port lead in surface, rounded corners and lifting lobe could be eliminated or altered to accommodate alternate tool styles.

The above description is that of the current embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property or privilege is claimed are defined as follows:

1. A one-piece, unitary manhole cover comprising:

an upper face;

an outer circumferential edge;

a lifting channel defined in said upper face; said lifting channel extending to said outer circumferential edge and defining a drainage opening in said outer circumferential edge, said channel including a channel floor having a first portion and a second portion, said second portion having a curved shape; and a lifting bar bridging said channel and spaced from said channel floor, said lifting bar including a lower surface facing said channel floor, said lower surface having a first portion and a second portion, wherein said first portion of said lifting bar lower surface is generally planar and wherein said second portion of said lifting bar lower surface includes a downwardly protruding lobe aligned above said curved second portion of said channel floor such that said lobe and said curved second portion of said floor cooperate to receive and provide leverage for a lifting tool.

2. The manhole cover of claim 1, wherein said first portion of said lifting bar lower surface is disposed over said first portion of said channel floor so as to provide lifting leverage to a tool inserted into said channel and under said lifting bar, wherein said first portion of said channel floor is generally planar.

3. The manhole cover of claim 2 wherein said lifting bar is disposed over said lifting channel away from said outer circumferential edge.

4. The manhole cover of claim 3 wherein said curved portion of said channel floor curves continuously to meet said upper face.

5. The manhole cover of claim 4 wherein said generally planar first portion of said lifting channel floor extends from said curved second portion of said channel floor and is parallel with said upper face.

6. The manhole cover of claim 5 wherein said lifting channel floor includes a pry bar port lead in surface extending from said generally planar first portion to said outer circumferential edge and sloping toward said upper face as said lead in surface extends out to said outer circumferential edge.

7. The manhole cover of claim 6, wherein said first portion of said lifting bar lower surface is aligned with said generally planar first portion of said channel floor such that said generally planar surfaces cooperate to receive and provide leverage for a pry tool.

8. The manhole cover of claim 7 wherein said lifting bar includes a first sidewall and a second sidewall, said first sidewall extending between said upper face and said lobe, said second sidewall extending between said upper face and said lower surface of said lifting bar.

9. A one-piece, unitary manhole cover comprising:

an upper face;

an outer circumferential edge;

a channel defined in a portion of said upper face, said channel including a channel floor extending through said outer circumferential edge whereby said channel is configured to drain out of said outer circumferential edge, said channel having a width extending generally parallel to said outer circumferential edge and a length extending generally perpendicular to said outer circumferential edge;

a bar spanning said width of said channel and having first and second opposing sidewalls, said bar including a lower surface facing said channel floor, wherein said lower surface includes a first portion and a second portion, wherein said first portion is generally planar and wherein said second portion includes a lobe adjacent said first sidewall and projecting from said bar toward said channel floor, wherein said channel floor includes a concave arc shaped portion aligned with and facing said lobe such that said channel and said bar are cooperatively configured to receive a lifting tool adjacent said first sidewall, said channel and said bar cooperatively configured to receive a prying tool adjacent said second sidewall.

10. The cover of claim 9 wherein lobe is positioned such that it is spaced from said second sidewall.

11. The cover of claim 10 wherein said channel includes an interior edge opposite said outer circumferential edge, said channel floor including a first portion extending from said concave arc shaped portion, said first portion extending to said outer circumferential edge and being generally flat, said concave arc shaped portion extending to said interior edge.

12. A one-piece, unitary manhole cover comprising:

an upper face;

an outer circumferential edge;

a channel defined in a portion of said upper face and extending through said outer circumferential edge whereby said channel is configured to drain out of said outer circumferential edge, said channel having a width extending generally parallel to said outer circumferential edge and a length extending generally perpendicular to said outer circumferential edge;

a bar spanning said width of said channel and having first and second opposing sidewalls, said channel and said bar cooperatively configured to receive a lifting tool adjacent said first sidewall, said channel and said bar cooperatively configured to receive a prying tool adjacent said second sidewall, wherein said bar includes a lower surface, said lower surface including a lobe extending downwardly therefrom, said lobe positioned proximate to said first sidewall, wherein said channel includes a floor and an interior edge opposite said outer circumferential edge, said floor including a first portion and a second portion, said first portion extending to said outer circumferential edge and being generally flat, said second portion extending to said interior edge and being generally arc shaped, wherein at least part of said second portion of said channel floor extends below said first portion of said channel floor.

* * * * *